United States Patent [19]

Kobayashi

[11] Patent Number: 5,022,373

[45] Date of Patent: Jun. 11, 1991

[54] FUEL INJECTION CONTROL APPARATUS FOR INTERNAL COMBUSTION ENGINE

[75] Inventor: Yoshiyuki Kobayashi, Hamamatsu, Japan

[73] Assignee: Suzuki Jidosha Kogyo Kabushiki Kaisha, Shizuoka, Japan

[21] Appl. No.: 467,037

[22] Filed: Jan. 18, 1990

[30] Foreign Application Priority Data

Jan. 31, 1989 [JP] Japan ..... 1-21527

[51] Int. Cl.[5] ..... F02D 41/04

[52] U.S. Cl. ..... 123/488; 123/494

[58] Field of Search ..... 123/478, 488, 494

[56] References Cited

U.S. PATENT DOCUMENTS

| | | | |
|---|---|---|---|
| 4,010,717 | 3/1977 | Taplin | 123/488 X |
| 4,313,412 | 2/1982 | Hosaka et al. | 123/480 |
| 4,594,987 | 6/1986 | Wataya et al. | 123/494 |

FOREIGN PATENT DOCUMENTS

| | | | |
|---|---|---|---|
| 174145 | 10/1983 | Japan | 123/494 |
| 61-123729 | 6/1986 | Japan . | |
| 63-189651 | 8/1988 | Japan . | |

*Primary Examiner*—Tony M. Argenbright

*Attorney, Agent, or Firm*—Flynn, Thiel, Boutell & Tanis

[57] ABSTRACT

A fuel injection control apparatus for an internal combustion engine includes a fuel injection valve, a throttle valve positioned in an inlet passage, a bypass passage communicating with the inlet passage downstream of the throttle valve, an arrangement for admitting ambient air into the bypass passage, and means for calculating a normally desired amount of fuel to be injected into the inlet passage by the fuel injection valve based on the air pressure in the bypass passage. In order to compensate for differences between the respective air pressures in the bypass passage and the downstream part of the inlet passage, means are provided for calculating an adjusted amount of fuel to be injected which is different from the normally desired amount of fuel.

4 Claims, 6 Drawing Sheets

FUEL INJECTION CONTROL APPARATUS FOR INTERNAL COMBUSTION ENGINE

FIELD OF THE INVENTION

This invention relates to a fuel injection control apparatus for an internal combustion engine and particularly to a fuel injection control apparatus for an internal combustion engine capable of improving performance by properly controlling the quantity of fuel injected while protecting the function of a pressure sensor.

BACKGROUND OF THE INVENTION

Some internal combustion engines for vehicles are equipped with an electronic fuel injection control apparatus as a countermeasure for such problems as harmful exhaust components, fuel consumption ratio, etc. Among such fuel injection control apparatuses, there is one system wherein the air quantity intaken by the internal combustion engine per one cycle is generally proportional to the absolute pressure within the intake manifold. The fuel injection control apparatus of this system establishes the quantity of fuel to be injected in view of various conditions such as pressure detected by a pressure sensor, engine speed and the like.

Examples of conventional fuel injection control apparatuses are disclosed in Japanese Patent Early Laid-open Publication No. Sho 61-123729 and Japanese Patent Early Laid-open Publication No. Sho 63-189651. The apparatus disclosed in the former publication is designed such that when it is operated with high loads at warming-up time, the correction factor of an output increasing quantity is established in accordance with the warming-up state in order to prevent the air fuel ratio from becoming too thick or dense. Similarly, the apparatus disclosed in the latter publication includes a bypass air passage bypassing an inlet throttle valve, and an auxiliary air valve for regulating the air rate flowing through this bypass air passage, the idle rotating speed being controlled by means of an idle rotating speed control system of a throttle bypass system.

Also, in the conventional fuel injection control apparatus, the inlet passage pressure as one control factor for establishing the quantity of injected fuel is detected by a signal output from a pressure sensor 106 (FIG. 9) which is disposed at a connecting pipe 104 which communicates with the interior of the intake manifold 102.

However, when the pressure in the intake manifold 102 is measured as mentioned, moisture due to fuel and EGR (exhaust gas recirculation) flows into the pressure sensor 106. As a result of this moisture, the functioning of the pressure sensor 106 deteriorates.

Also, as is shown in FIG. 2, there is conventionally provided a bypass air passage 12 in order to direct a fast idle air so that it bypasses the inlet throttle valve 8 and is fed to the downstream side of the inlet throttle valve 8. The air under pressure is guided through the bypass air passage 12 (on the downstream side of an air valve 14 for opening and closing an opening 16 of the bypass air passage 12) and communicates with a pressure sensor 18 via a passage 20. Thus, it is assumed that the pressure in bypass passage 12 normally approximates the pressure in the inlet passage 6. Because the possibility of moisture due to fuel and EGR flowing into the pressure sensor 18 is small, this conventional structure is often used.

However, in the construction where the air pressure in the bypass air passage 12 on the downstream side of the air valve 14 is measured, as shown in FIG. 2, a large quantity of air flows through passage 12 when the engine temperature is low, because the air valve 14 widely opens the opening 16 of the bypass air passage 12. Thus, when the inlet throttle valve 8 is generally entirely closed, that is, at the idling operation time, the relation between the pressure $P_1$ (absolute pressure) of the bypass air passage 12 on the downstream side of the air valve 14 and the pressure $P_2$ (absolute pressure) of the inlet air passage 6 on the downstream side of the inlet throttle valve 8 is such that $P_1$ is significantly greater than $P_2$ (i.e. $P_1 >> P_2$). Accordingly, a control means (not shown) determines that the bypass pressure $P_1$ detected by the pressure sensor 18 is large at a time when the pressure $P_2$ is significantly less than $P_1$. Because of the foregoing reason, the control means erroneously actuates a fuel injection valve 10 in order to enrich (needlessly) the air fuel ratio.

On the other hand, when the opening degree (angle) of the inlet throttle valve 8 becomes large, the pressure relationship becomes $P_1 \approx P_2$. Therefore, the control means performs a normal air fuel ratio controlling function.

However, when the opening degree of the throttle valve 8 is large, the air fuel ratio becomes rich in the idling state. When matching (establishing) is effected in order to bring this state into a proper state, the air fuel ratio sometimes becomes lean during operation. According to test results, the difference between the pressure $P_1$ in the bypass air passage 12 on the downstream side of the air valve 14 and the pressure $P_2$ in the inlet air passage 6 on the downstream side of the inlet throttle valve 8 reaches a maximum of about 28% in a multicylinder internal combustion engine, as shown in FIGS. 10 and 11. Accordingly, there is an inconvenience in that the injection quantity of fuel is needlessly adjusted and uselessly fluctuated, which degrades performance. In FIG. 2, reference character Pa denotes an atmospheric pressure.

Therefore, the object of the present invention is, for the purpose of obviating the above inconvenience, to provide a fuel injection control apparatus for an internal combustion engine in which the pressure $P_1$ in the bypass passage is measured by a sensor, a correction factor for the fuel injection quantity is calculated in accordance with at least the engine temperature, the fuel injection is controlled by such obtained correction factor, and the quantity of injected fuel is properly controlled to improve the operation performance while protecting the function of the pressure sensor.

SUMMARY OF THE INVENTION

In attempting to achieve this object, the present invention provides a fuel injection control apparatus for an internal combustion engine for establishing a fuel quantity to be injected from a fuel injection valve based on at least inlet air pressure and engine speed, characterized in that there is provided a pressure sensor adapted to detect air pressure in a bypass air passage. The bypass air passage is adapted to guide air into an inlet passage which is downstream from an inlet throttle valve, thus bypassing said inlet throttle valve. Also provided is a control means adapted to calculate a correction factor in accordance with at least the temperature of said internal combustion engine and to control the quantity of fuel injected from said fuel injection valve in accordance with such obtained correction factor.

By this use of the correction factor, deterioration of the function of the pressure sensor can be prevented, and even if a difference between the pressure $P_1$ of the bypass air passage and the pressure $P_2$ of the inlet air passage exists, the performance can be improved by properly controlling the quantity of injected fuel.

BRIEF DESCRIPTION OF THE DRAWINGS

The embodiments of the present invention will be described in detail with reference to the drawings, in which.

DETAILED DESCRIPTION

Figure 1:
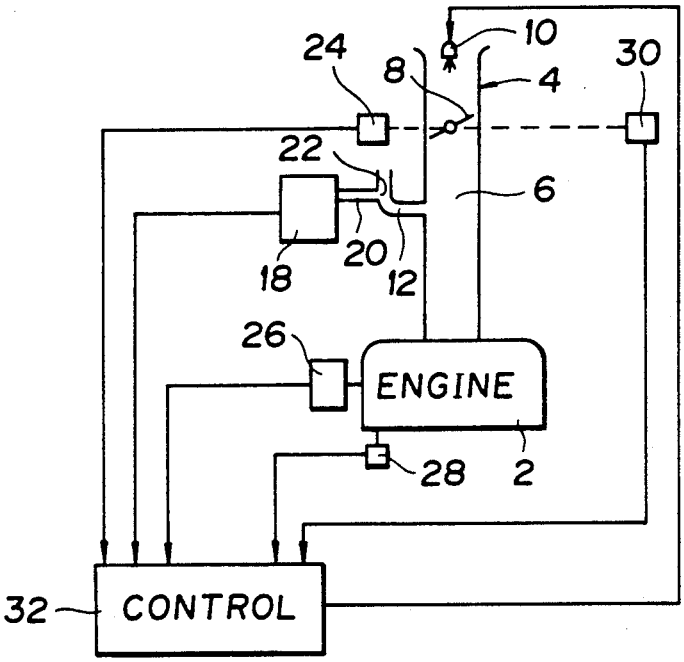
FIG. 1 is a schematic view of a fuel injection control apparatus.

FIGS. 1 through 4 show a first embodiment. In the drawings, reference numeral 2 denotes an internal combustion engine, 4 an intake manifold, and 6 an inlet air passage. The inlet air passage 6 is provided with an inlet throttle valve 8 and a fuel injection valve 10 disposed on the upstream side of the inlet throttle valve 8.

Figure 2:
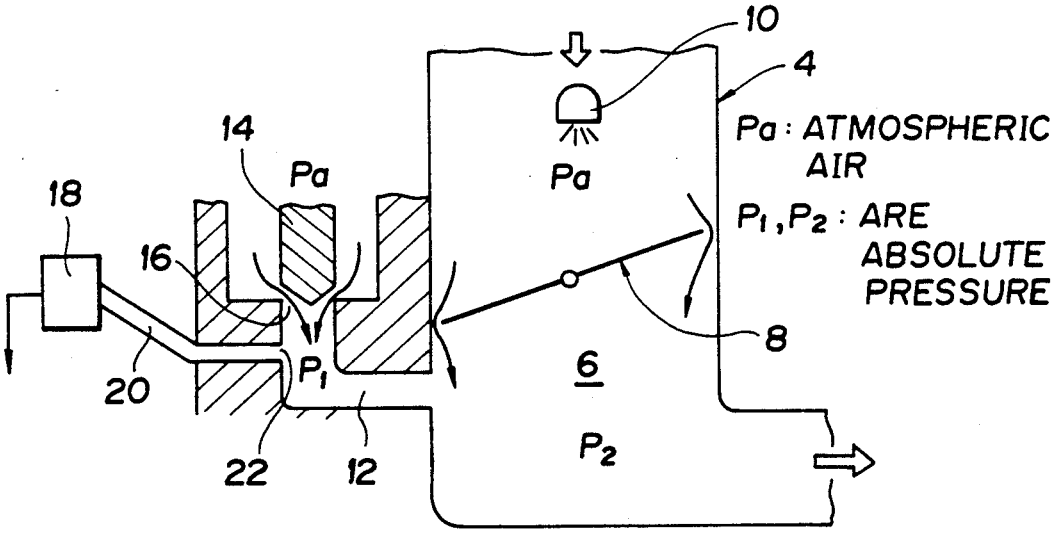
FIG. 2 is an enlarged view of an important part of FIG. 1.

Also, as is shown in FIG. 2 and discussed above, there is provided a bypass air passage 12 adapted to supply idle air into the inlet air passage 6 on the downstream side of the inlet throttle valve 8 and thus bypass the inlet throttle valve 8. Air flowing through this bypass air passage 12 is regulated by an air valve 14 which varies the effective size of an opening 16 communicated with the passage 12.

The bypass air passage 12 on the downstream side of the air valve 14 communicates with an inlet port 22 of a connecting passage 20 which is connected to a pressure sensor 18. As mentioned above, by communicating the pressure sensor 18 with the bypass air passage 12 on the downstream side of the air valve 14, moisture from fuel and EGR can be prevented from flowing into the pressure sensor 18 and freezing, etc. can be prevented, so that the pressure sensor 18 is protected to prolong its durability.

This sensor 18, a throttle opening angle sensor 24 for detecting the opening angle (in degrees) of the inlet throttle valve 8, an engine speed sensor 26 for detecting the engine speed, a coolant temperature sensor 28 for detecting the cooling water temperature of the internal combustion engine 2, and an idle switch 30 are communicated with a control means 32 (see FIG. 1). This control means 32 is used in a so-called speed density type fuel injection control apparatus which establishes the basic fuel injection quantity based on at least the inlet passage pressure and the engine speed.

Figure 3:
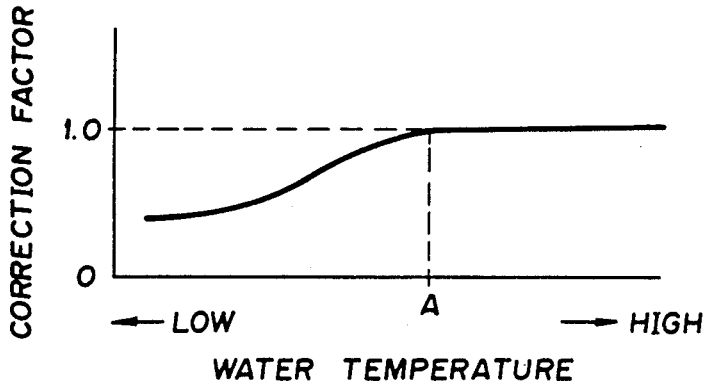
FIG. 3 is a graphic illustration showing the relation between cooling water temperature and the correction factor.

Also, the control means 32 calculates a correction factor in accordance with at least the cooling water temperature (representative of the temperature of the internal combustion engine 2) and controls the quantity of fuel injected from the fuel injection valve 10 in accordance with the thus obtained correction factor. More specifically, in this first embodiment, when the idle switch 30 is in its ON position or the opening angle of the inlet throttle valve 8 is less than a predetermined value, in other words, at a low temperature time, the control means 32 either corrects (in the decreasing direction) the value of the bypass passage pressure $P_1$ detected by the pressure sensor 18, or directly corrects the final injection time of the fuel injection valve 10 to establish the quantity of fuel injected, based on the correction factor of FIG. 3 which is established in accordance with the cooling water temperature. In FIG. 3, when the cooling water temperature has reached a certain value A, the correction factor becomes 1.0.

Figure 4:
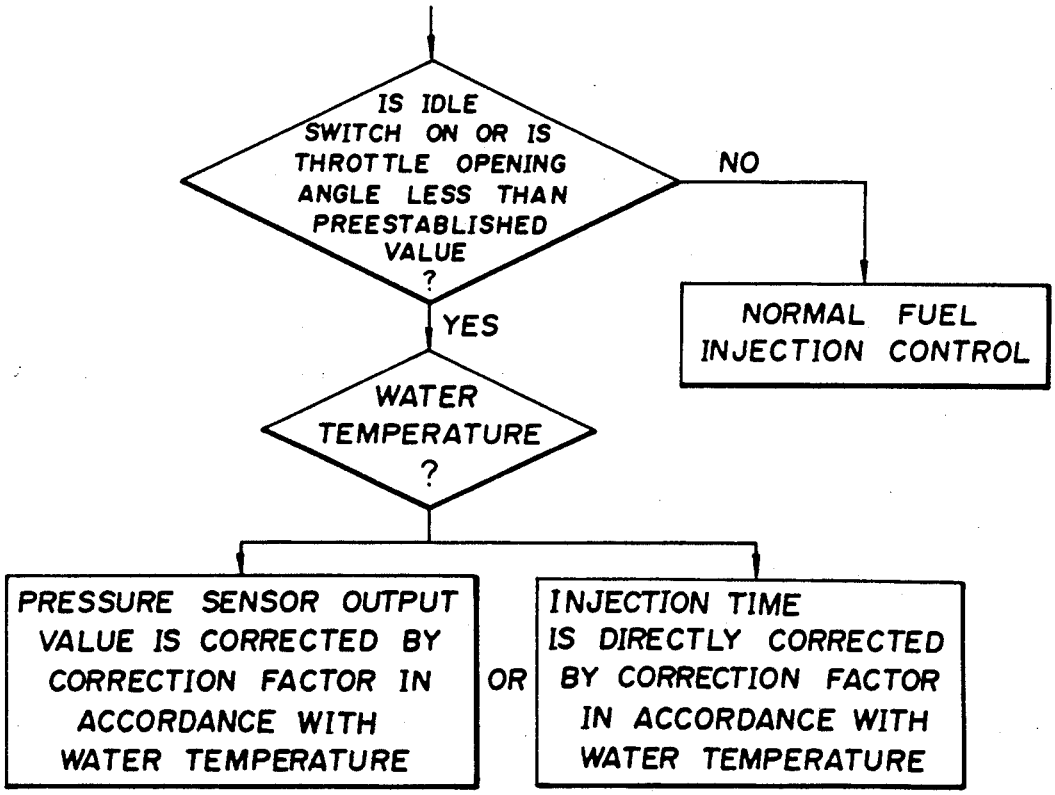
FIG. 4 is a flow chart for explaining the operation of a first embodiment of the invention.

Next, the operation of this embodiment will be described with reference to the flow chart of FIG. 4.

The control means 32 first determines whether the idle switch 30 is in its ON position or whether the degree of opening of the inlet throttle valve 8 is less than a predetermined value.

When the answer is NO because the idle switch 30 is in its OFF position and the opening angle of the inlet throttle valve 8 is at or exceeds the predetermined value, a normal fuel injection control is performed.

On the other hand, when the answer is YES because either the idle switch 30 is in its ON position, or the opening angle of the inlet throttle valve 8 is less than the predetermined value, the control means 32 calculates a correction factor in accordance with the cooling water temperature which is detected by the water temperature sensor 28 in FIG. 1, and either corrects the value of the bypass passage pressure $P_1$ (i.e., corrected pressure value varies as the product of detected pressure value multiplied by the correction factor) based on the correction factor, or directly corrects the established final injection time (i.e., correction factors from all sensors are calculated and the value of the actual injection period of time at the time point when the calculation is made is multiplied by the correction factor), thereby to control the injection quantity of fuel from the fuel injection valve 10.

As a result, when the pressure $P_1$ in the bypass passage 12 is sensed by the pressure sensor 18 to approximate the pressure in the inlet passage 6 in order to prevent fuel and moisture from flowing into the pressure sensor 18, the function of the pressure sensor 18 can be favorably maintained. Moreover, even when the pressure $P_1$ of the bypass air passage 12 on the downstream side of the air valve 14 is different from the pressure $P_2$ of the inlet air passage 6 on the downstream side of the inlet throttle valve 8, the injection quantity of fuel can be appropriately controlled and performance can be improved.

It should be obvious to those skilled in the art that the control means 32 may be implemented, for example, with a conventional microprocessor circuit.

Figure 5:
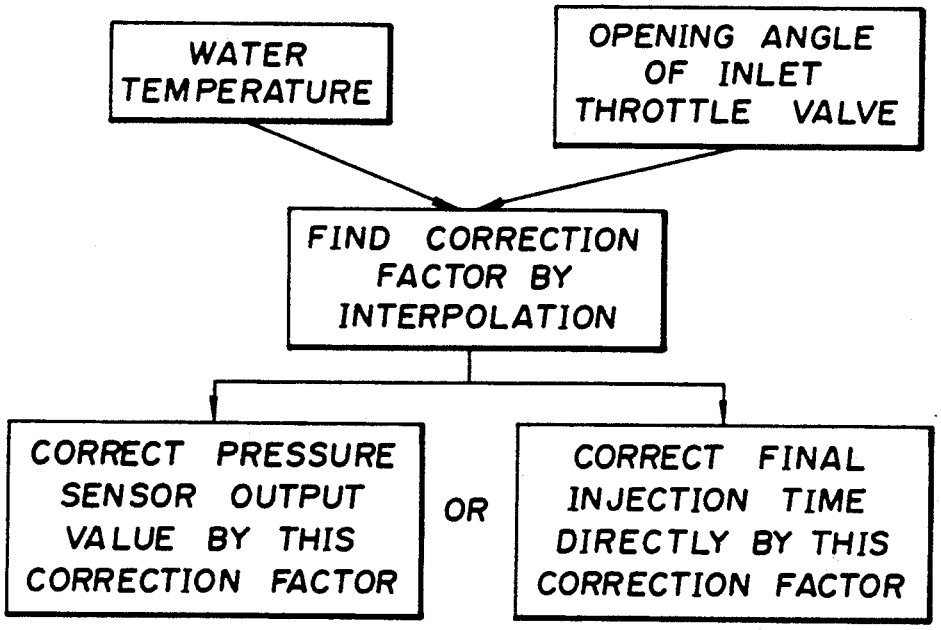
FIG. 5 is a flow chart for explaining the operation of a second embodiment of the invention.
Figure 6:
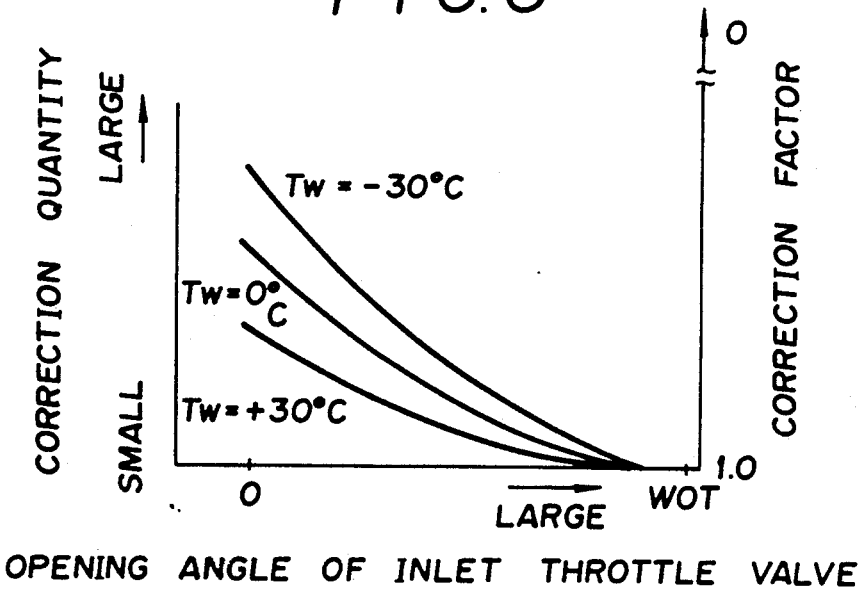
FIG. 6 is a graphic illustration showing the relation between the opening angle of the inlet throttle valve and the correction factor, at various engine temperatures.

FIGS. 5 and 6 show a second embodiment of the present invention. In the embodiments as will be described hereinafter, the parts having the same functions as the first embodiment are represented by the same reference numerals or characters.

The features of this second embodiment are as follows. A table showing both the opening angle $\theta$ (in degrees) of the inlet throttle valve 8, and the cooling water temperatures (see table below) is prepared. There is provided the control means 32 for directly correcting either the bypass passage pressure value detected by the pressure sensor 18, or the final injection time, by making interpolations between numeric table values to extract the correction factor.

CORRECTION FACTOR VALUES FOR SELECTED WATER TEMPERATURES AND THROTTLE VALVE OPENING ANGLES Θ

| | water temperature | | | | |
|---|---|---|---|---|---|
| Θ | −30° C. | −15° C. | 0° C. | +15° C. | +30° C. |
| 0° | 0.8 | 0.9 | 0.95 | 1.0 | 1.0 |
| 4° | 0.85 | 0.9 | 0.95 | 1.0 | 1.0 |
| 8° | 0.85 | 0.9 | 0.95 | 1.0 | 1.0 |
| 10° | 0.9 | 0.95 | 1.0 | 1.0 | 1.0 |

According to the construction of this second embodiment, as is shown in FIG. 6, a correction factor is established based on the relation between the cooling water temperature Tw and the opening angle of the inlet throttle valve 8. The correction factor is established by interpolation between the curves of FIG. 6, which curves are produced using data from a table such as the one above. In accordance with such obtained correction factor, either the value of the bypass passage pressure detected by the pressure sensor 18 is corrected or the final injection time is directly corrected to establish the desired injection quantity of fuel. In FIG. 6, when the opening angle of the inlet throttle valve 8 is small, if the cooling water temperature is low, the correction quantity (i.e. amount of correction) becomes large (small correction factor), and thus the corrected pressure value is small relative to the detected pressure value. If the cooling water temperature is high, the amount of correction becomes small (large correction factor), and the corrected pressure value is close to the detected value. On the other hand, when the opening angle of the inlet throttle valve 8 is large, the amount of correction becomes approximately zero (correction factor $\approx 1.0$).

Figure 7:
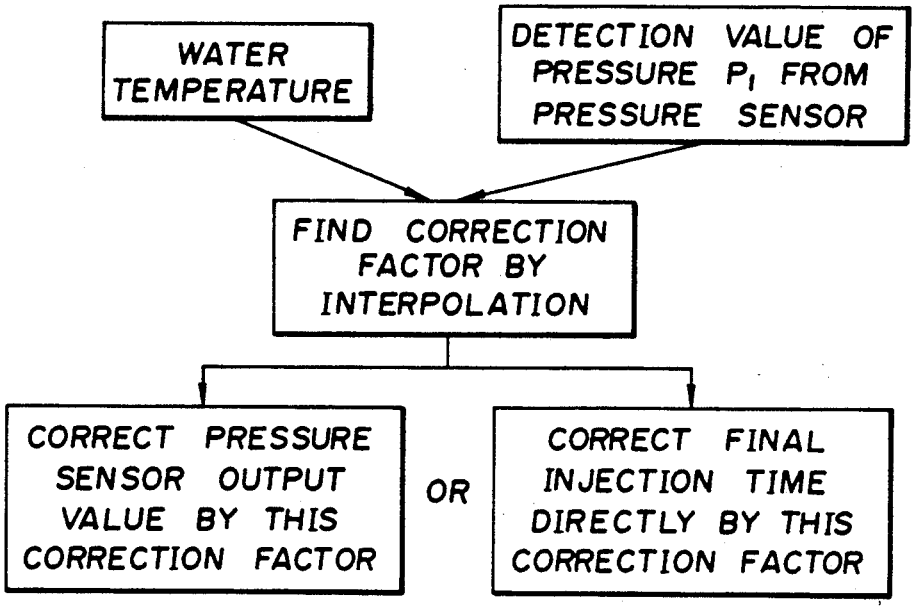
FIG. 7 is the flow chart for explaining the operation of a third embodiment of the invention.
Figure 8:
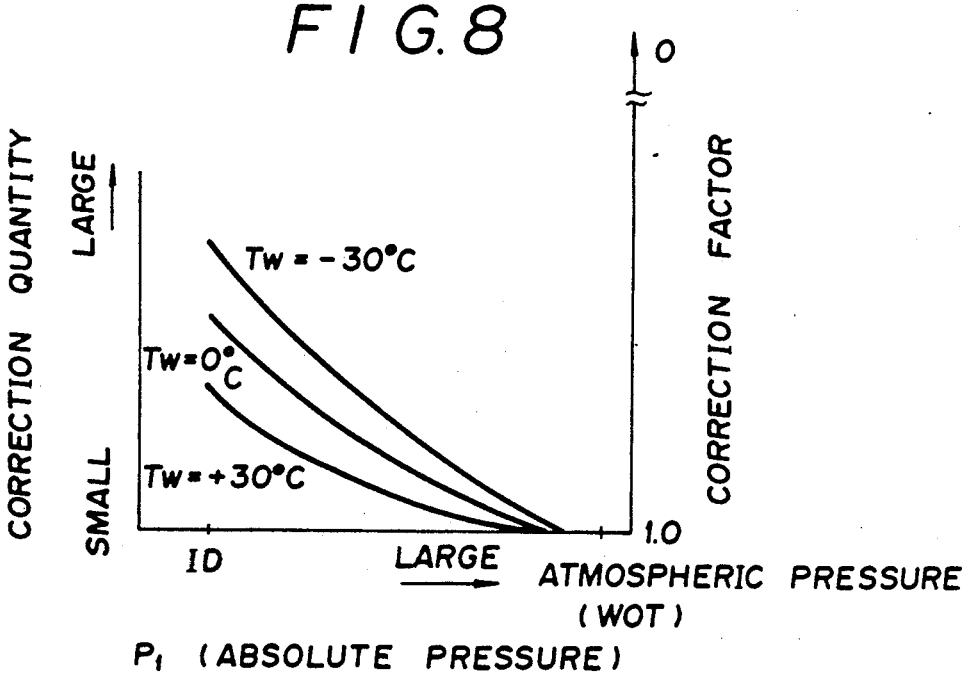
FIG. 8 is a graphic illustration showing the relation between the inlet passage pressure and the correction factor, at various engine temperatures.
Figure 9:
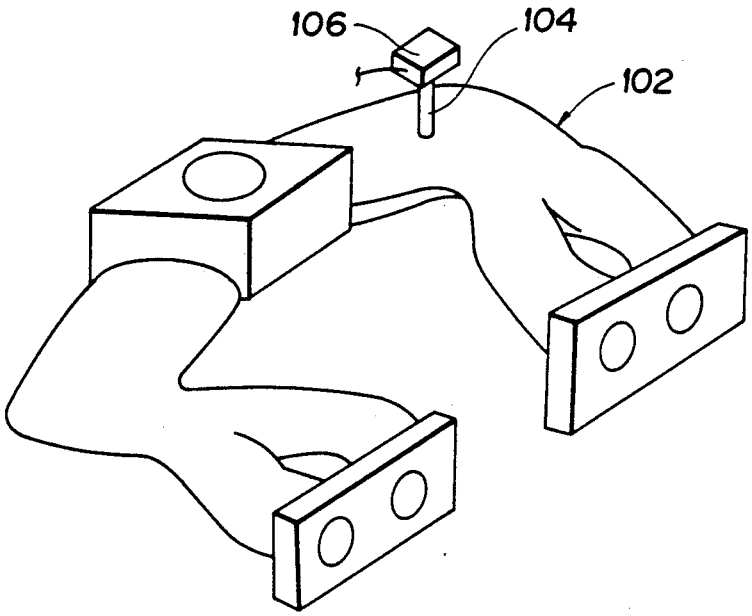
FIG. 9 PRIOR ART
FIG. 9 is a perspective view of an intake manifold of a prior art apparatus, where the pressure in the intake manifold is measured.
Figure 10:
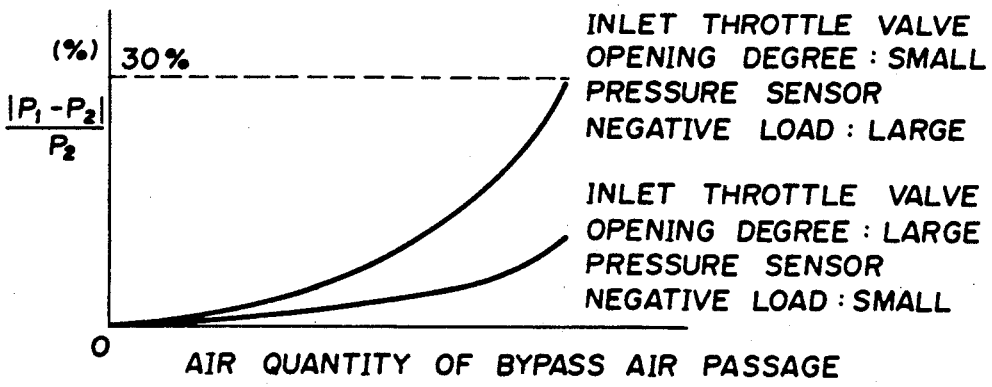
FIGS. 10 and 11 are graphic illustrations of test results in conventional engines showing the influence of the bypass air passage pressure due to the quantity of air in the bypass air passage on the downstream side of the air valve.
Figure 11:
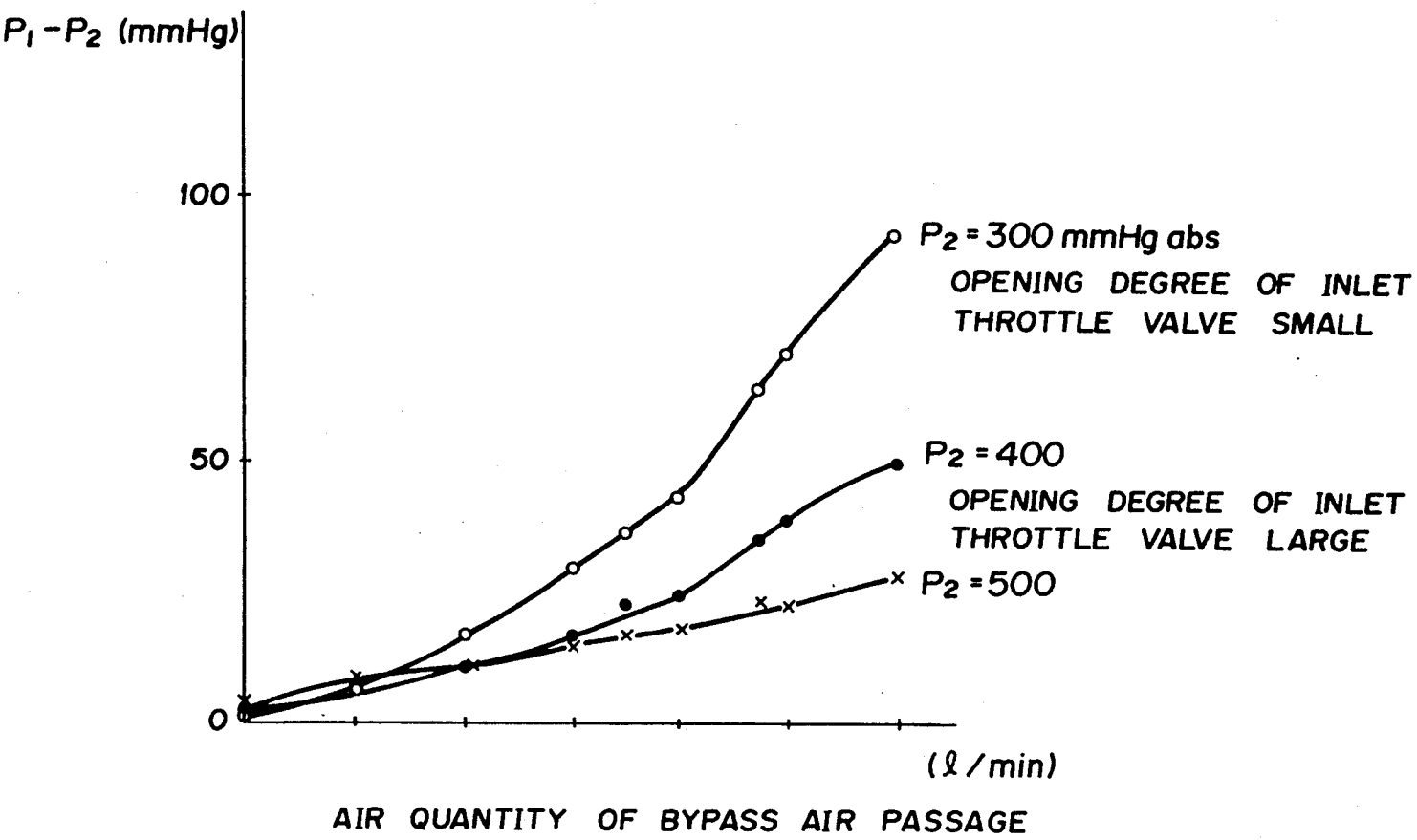

FIGS. 7 and 8 show a third embodiment of the present invention.

The features of this third embodiment are as follows. A table similar to the one above, but showing the correction factor for various values of pressure $P_1$ detected by the pressure sensor 18 and cooling water temperature, is employed. The control means 32 directly corrects either the pressure value detected by the pressure sensor 18, or the final injection time, by making interpolations between numeric correction factor values and extracting the appropriate correction factor.

According to the construction of this third embodiment, as is shown in FIG. 8, a correction factor is established in accordance with both the detected pressure value $P_1$, and the cooling water temperature Tw. The correction factor may be established by interpolation as indicated above, and in accordance with such obtained correction factor, either the pressure value as detected by the pressure sensor 18 is corrected, or the final injection time is directly corrected to establish the desired quantity of fuel to be injected. In FIG. 8, when the value of the inlet pipe pressure $P_1$ is small, and if the cooling water temperature is low, the correction quantity (i.e. amount of correction) becomes large (small correction factor), and if the cooling water temperature is high, the amount of correction becomes small (large correction factor). On the other hand, when the value of the inlet pipe pressure $P_1$ is large, the amount of correction becomes approximately zero (correction factor $\approx 1.0$).

As apparent from the above detailed description, in accordance with the present invention, by providing control means for taking the pressure of the bypass air passage as detected by the pressure sensor, calculating the correction factor in accordance with at least the temperature of the internal combustion engine, and controlling the quantity of fuel injected from the fuel injection valve by such obtained correction factor, the function of the pressure sensor can be favorably maintained. When the pressure of the bypass air passage is sensed, even if the pressure of the bypass passage differs from the pressure of the inlet passage, the performance can be improved by properly controlling the quantity of fuel injected.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a fuel injection control apparatus for an internal combustion engine having a fuel injection valve, a throttle valve positioned in an inlet passage, a bypass passage communicating with said inlet passage downstream of said throttle valve, means for admitting ambient air into said bypass passage, and means for calculating a normally desired amount of fuel to be injected into said inlet passage by said fuel injection valve based on the air pressure in said bypass passage, said bypass passage pressure being used as an approximation of the pressure in said inlet passage downstream of said throttle valve, the improvement wherein said calculating means includes compensation means for compensating for differences between the air pressure in said bypass passage and the air pressure in said downstream part of said inlet passage by calculating an adjusted amount of fuel to be injected which differs from said normally desired amount.

2. The fuel injection control apparatus according to claim 1, wherein said compensation means includes means for producing a correction factor based on the temperature of the engine in response to either the engine being in an idle state or said throttle valve being opened less than a predetermined amount.

3. The fuel injection control apparatus according to claim 1, wherein said compensation means includes means for producing a correction factor based on the temperature of the engine and an angle to which said throttle valve is opened.

4. The fuel injection control apparatus according to claim 1, wherein said compensation means includes means for producing a correction factor based on the temperature of the engine and the air pressure in said bypass passage.

* * * * *